United States Patent [19]

Ross

[11] Patent Number: 4,827,697

[45] **Date of Patent: * May 9, 1989**

[54] SETTLING SYSTEMS FOR BAG-IN-BOX MACHINES

[75] Inventor: Graham J. Ross, Hingham, Mass.

[73] Assignee: Pneumatic Scale Corporation, Quincy, Mass.

[ * ] Notice: The portion of the term of this patent subsequent to Jan. 12, 2005 has been disclaimed.

[21] Appl. No.: 142,732

[22] Filed: Jan. 11, 1988

Related U.S. Application Data

[63] Continuation of Ser. No. 892,375, Aug. 4, 1986, Pat. No. 4,718,217.

[51] Int. Cl.[4] ..... B65B 9/08; B65B 1/22; B65B 57/10

[52] U.S. Cl. ..... 53/437; 53/451; 53/525; 53/551; 53/75

[58] Field of Search ..... 53/525, 529, 503, 504, 53/551, 552, 550, 437, 438, 451, 55, 75

[56] References Cited

U.S. PATENT DOCUMENTS

| | | | |
|---|---|---|---|
| 2,655,777 | 10/1953 | Hagen | 53/55 X |
| 3,296,770 | 1/1967 | Wilson | 493/302 X |
| 3,983,682 | 10/1976 | Scully | 53/126 |
| 4,018,029 | 4/1977 | Safranski et al. | 53/551 X |
| 4,019,547 | 4/1977 | Ross | 53/525 X |
| 4,040,230 | 8/1977 | Pressel et al. | 53/504 X |
| 4,043,098 | 8/1977 | Putnam, Jr. et al. | 53/551 |
| 4,407,108 | 10/1983 | Craig | 53/551 X |
| 4,514,959 | 5/1985 | Shroyer | 53/552 X |
| 4,520,615 | 6/1985 | Engler et al. | 53/550 |
| 4,548,286 | 10/1985 | Sashiki et al. | 53/503 X |
| 4,571,926 | 2/1986 | Scully | 53/552 X |
| 4,597,240 | 7/1986 | Scully | 53/552 X |
| 4,718,217 | 1/1988 | Ross | 53/525 X |

*Primary Examiner*—Horace M. Culver

*Attorney, Agent, or Firm*—Robert T. Gammons; Robert M. Asher

[57] ABSTRACT

Apparatus and method for packaging particulate product in bags for deposit into cartons of predetermined cross section and height. Sheet material is formed about a filling tube. The sheet material is sealed and severed beneath the filling tube creating the top of one bag and the bottom of the next. Product is dropped through the filling tube into the formed sheet material which is vibrated. A sensor may be used to determine if product exceeds a predetermined height. After a predetermined amount of product has been dropped into the sheet material, the material is lowered, sealed and severd to form a filled bag.

9 Claims, 1 Drawing Sheet

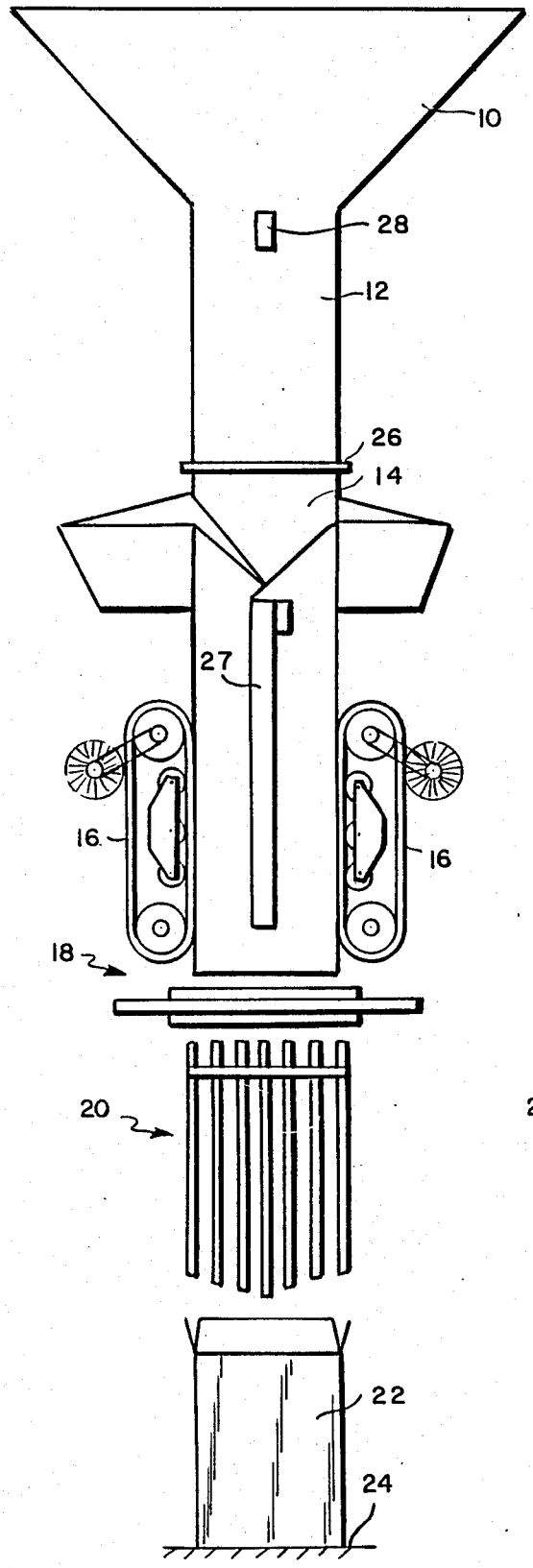
FIG. 1
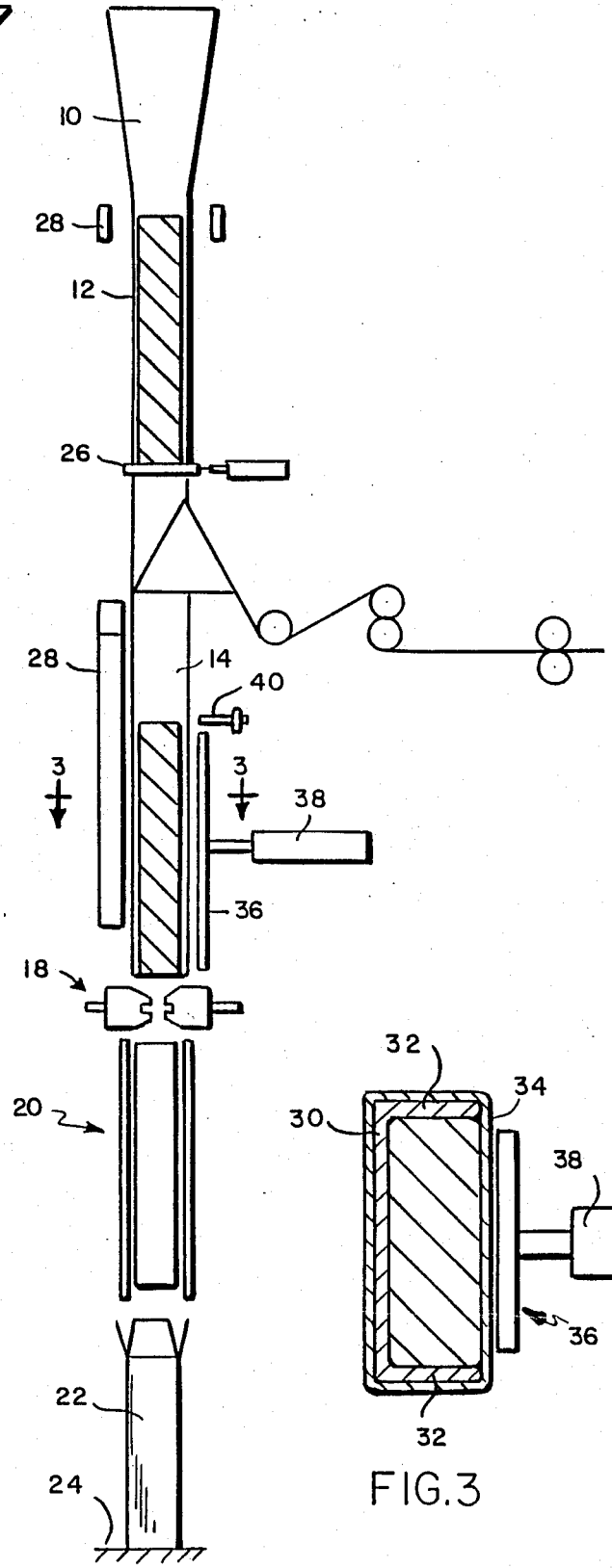
FIG. 2
FIG. 3

SETTLING SYSTEMS FOR BAG-IN-BOX MACHINES

This is a continuation of co-pending application Ser. No. 892,375, filed on Aug. 4, 1986, now U.S. Pat. No. 4,718,217.

BACKGROUND OF THE INVENTION

In U.S. Pat. Nos. 3,983,682 and 4,571,926, there are shown apparatus for delivering a predetermined weight of particular material into a bag and thereafter depositing the bag in a carton. I the aforesaid applications, the bag is formed on the outside of a filling tube and the product is delivered into the filling tube, whereupon the bag is moved downwardly from the filling tube and, as it descends, the particulate material gravitates from the filling tube into the bag. The lower end of the bag is sealed and served prior to descent from the filling tube to form the lower end of the bag and when the upper end of the filled bag leaves the filling tube, the upper end is sealed and severed to form the top of a filled bag. The means for moving the bag forming material downwardly is operated intermittently to move a predetermined length of bag forming material relative to the sealing and severing means so that the successive bag lengths are of equal length. Due to the fact that the volume of produce per unit weight can vary, it can happen that the weighed product when delivered into the bag sealed at its lower end between the sealing and severing means will exceed the length of the bag and, as a consequence, when the filled bag is lowered to present a succeeding bag length for filling, the volume of product in the lowered bag will exceed the predetermined length of bag such that it stands above the sealing and severing means. Consequently, when the latter are engaged, product will be jammed between the sealing and severing means sufficiently so that the bag will be destroyed and the machine stopped. It is the purpose of this invention to alleviate the foregoing possibility of jamming by reducing the volume of the product deposited in the bag above the sealing and severing means sufficiently so that when it is moved downwardly between the sealing and severing jaws, the level of the product in the bag will be less than the predetermined length of bag and, hence, below the sealing and severing jaws.

SUMMARY OF THE INVENTION

As herein illustrated, the apparatus of the instant invention is designed to fill bags of predetermined length with particulate material and deposit them in cartons of predetermined cross section and height and comprises a measuring tube for receiving a predetermined weight of product provided with a gate for holding the product therein, a filling tube for receiving the product from the measuring tube, means for forming sheet material into a tube on the filling tube, means for moving said predetermined length of formed tube downwardly on the filling tube for gravitationally receiving the product from the filling tube and means for intermittently forming a seal of predetermined length transversely of the forming tube and severing the tube within the sealed length to form the top and bottom of successive bags of predetermined length. The severed bags are dropped through a shape-retaining device into a carton supported therebelow. The apparatus is operated cyclically to form predetermined bag lengths, fill the bag lengths with product, seal and separate the bags from successive bags and deposit them in cartons.

In accordance with the invention, there is provided first sensing means for detecting the level of the product in the measuring tube prior to release therefrom into the forming tube and if it exceeds a predetermined height, effecting actuation of a vibrator for vibrating the product released from the measuring tube into the filling tube. If the product, when fully deposited in the forming tube, is of such predetermined height as to be contained wholly within the predetermined bag length formed at each cycle of operation, the cycle will repeat without interruption. The vibrator will continue to operate so long as the first sensing means detects an abnormal height in the measuring tube. Second sensing means is positioned adjacent the filling tube at a level to measure the height of the product delivered into the filling tube and in the event that the product, when fully deposited in the filling tube, still exceeds the predetermined allowable height for the bag length, the second sensing means will operate to interrupt operation of the cycle of operation. The vibrator means will continue to operate so long as the second sensing means detects product in the filling tube exceeding in height the predetermined bag length. When the volume of product in the filling tube subsides to the allowable height, the second sensing means will reinstate the cycle of operation and cycling will continue uninterrupted until the second sensor again indicates an excessive height of product in the filling tube. The cross section of the measuring tube and filling tube corresponds substantially in cross section to the cross section of the carton within which the filled bag is to be deposited and are of rectangular cross section. The filling tube is defined by three sides and an open fourth side. The vibrator is disposed at the open fourth side in a position to have contact with the bag exposed at the open fourth side of the filling tube. Product is delivered into the measuring tube from a hopper positioned above the upper end of the measuring tube.

The invention will now be described in greater detail with respect to the accompanying drawings, wherein:

FIG. 1 is a diagrammatic front elevation of the filling machine according to this invention; and FIG. 2 is a diagrammatic side elevation of the filling machine shown in FIG. 1 as seen from the right-hand side; and FIG. 3 is a horizontal section taken on the line 3—3 of FIG. 2.

Referring to the drawings, FIGS. 1 to 2, the filling apparatus comprises a hopper 10, a measuring tube 12, a filling tube 14, feeding means 10, a measuring tube 12, a filling formed about the filling tube downwardly thereon, sealing and severing means 18-18 for forming the bottoms and tops of successive bags and releasing them, and shape-retaining means 20 for confining the released bags and guiding them into open-end cartons 22 resting on a support 24 which may, for example, be a conveyor for moving containers successively into position for receiving a released bag and then moving it away to provide for moving a succeeding carton into position.

The measuring tube and filling tube are of corresponding cross section and at the junction of the lower end of the measuring tube 12 and the upper end of the filling tube 14, there is a retractable closure gate 26. At the upper end of the measuring tube, there is a first sensing means 28 which detects the height of the product in the measuring tube.

Adjacent one side of the filling tube 14, there is a side sealing element 27 for forming a side seam as the bag-forming material is drawn onto the the filling tube 14 by the feeding means 16-16.

The filling tube 14, as shown in cross section in FIG. 3, has a closed side 30, closed ends 32-32 and an open side 34. Adjacent the open side 34, there is a vibrator plate 36 disposed parallel to the open side, operable by suitable means 38 to repeatedly strike the unsupported side of the bag-forming material at the open side 34 at appropriate times as will be disclosed hereinafter.

There is also mounted adjacent the open side 334 a sensor 40, FIG. 2, which detects the upper level of the product within the filling tube 14.

Under normal operating conditions, the apparatus is operated cyclically to deliver a predetermined weight of product from the measuring tube 12 into the filling tube 14 upon which the bag-forming material has been formed and sealed at its lower end, between the severing and sealing means 18-18, whereupon the severing and sealing means are retracted and the feeding means 16-16 is actuated to move a predetermined length of the formed bag downwardly between the retracted sealing and severing means into the shape-retaining means 20. As the formed bag is moved downwardly, the product within the filling tube gravitates from the filling tube into the bag. When a predetermined length of bag has been moved downwardly, the feeding means is aborted and the sealing and severing means is reengaged to form the top seal for the filled bag and the bottom seal for the succeeding bag. The cyclical operation of the apparatus will continue so long as the volume of product delivered into the measuring tube does not exceed in height the predetermined length of bag as determined by the feeding means 16-16. In the event, however, that the height of the product in the measuring tube 12 exceeds the predetermined length of bag forming material formed on the filling tube 14, the sensing device 28 will initiate operation of the vibrator 36 so as to effect vibration of the product as it is delivered into the filling tube 14. If, one the one hand, when the product enters the filling tube 14 and settles to the lower end of the bag formed on the filling tube and sealed at its lower end by the sealing and severing means, the height of product within the filling tube is commensurate with the predetermined length of the bag, the cyclical operation of the apparatus will continue without interruption. If, on the other hand, the height of the product in the filling tube 14 exceeds said predetermined height, the said sensing device 40 will interrupt the cycle of operation by stopping the feeding means 16-16 so that the sealing and severing means 18 remains engaged with the lower end of the bag while continuing operation of the vibrator means 36 until the product in the filling tube settles to a level such that its upper end clears the said sensing means 40, whereupon the cycle of operation will be re-initiated.

As thus described, the filling apparatus under normal operating conditions will fill successive predetermined lengths of bag with product without interruption. However, in the event that, for some reason, the volume of the product for a predetermined weight is excessive, the apparatus will detect the excessive height, effect vibration of the product to reduce its volume end, if necessary, interrupt the cycle of operation to reduce the volume to a height commensurate with the length of the bag within which it is to be deposited and when it is reduced to an acceptable height, re-initiate the next cycle of operation. Interruption of the cycles will be continues until the volume deposited in the measuring tube 12 corresponds in height to the predetermined length of bag delivered by the feeding means.

The cycling of the feeding means 16-16, the sealing and severing means 18-18 and closure 26 are controlled by suitable cam-operated switches. Operation of the vibrator 36 is controlled by the sensing means 28 and interruption of the cycle of operation is controlled by the sensing means 40.

It should be understood that the current disclosure is for the purpose of illustration only and includes all modifications or improvements which fall within the scope of the appended claims.

What is claimed is:

1. Cyclically operable apparatus for forming and filling bags with product, comprising:

a filling tube which extends down to a lower end, said filling tube having an open side, means for forming sheet material into a tube about said filling tube;

sealing and severing means, located at the lower end of said filling tube, for engaging the sheet material at predetermined intervals to form a sealed area transversely of the tube of sheet material and to sever the tube in said sealed area to form the top and bottom of successive bags, means for delivering product into the tube, vibrating means disposed at the open side of said filling tube for vibrating the sheet material, and means for lowering the sheet material about the tube so that after a predetermined amount of product is received in said tube of sheet material above said sealed area said sealing and severing means can be engaged to seal and sever a filled bag.

2. The apparatus of claim 1 further comprising:

sensing means for sensing the level of the product in the filling tube, operable to interrupt the cycle of operation if the height of the product in the filling tube exceeds a predetermined height so as to avoid jamming of said sealing and severing means.

3. The apparatus of claim 2 wherein said sensing means is operable to reinstate operation of the cycle when the level of the product in the filling tube subsides to a level below said predetermined height.

4. The apparatus of claim 1 further comprising a measuring tube disposed above said forming tube for receiving a predetermined weight of product and sensing means arranged adjacent said measuring tube operable in the event that the product in the measuring tube exceeds said predetermined height to initiate operation of said vibrating means.

5. Cyclically operable apparatus for forming and filling bags with product comprising:

a filling tube;

shape retaining means;

sealing and severing means situated between said filling tube and said shape-retaining means;

means for lowering a bag forming material over said filling tube;

a measuring tube disposed above said filling tube for receiving a predetermined weight of product;

means for delivering product from said measuring tube into said filling tube, said sealing and severing means at the lower end of the filling tube operating by engagement with the bag forming material to form the lower end of a bag to retain product within said bag;

vibrating means for vibrating the bag forming material on said filling tube; and sensing means arranged adjacent said measuring tube operable in the event than the production the measuring tube exceeds a predetermined height to initiate operation of said vibrating means.

6. The apparatus of claim 5 further comprising second sensing means disposed adjacent said filling tube operable, in the event that the product exceeds a level such that when the bag is lowered into position beneath said jaws the product would be high enough to be between said jaws, to interrupt the cycle of operation until said product settles below said level.

7. The apparatus of claim 5 wherein said filling tube has an open side and said vibrating means is disposed adjacent the open side of said filling tube for vibrating said bag forming material.

8. The method of forming and filling bags with a predetermined weight of product, comprising forming sheet material into a tube with a closed lower end, depositing a predetermined weight of product into the tube, sensing the height of the product in the tube to determine if it exceeds a predetermined height above the bottom of the tube, effecting vibration of the tube if the product exceeds the predetermined height to settle the product in the tube to a level below a desired upper end for a bag and then sealing the desired upper end to complete the bag.

9. The method of forming and filling bags with product, comprising forming bag-forming sheet material into a tube on a hollow filling tube, sealing the lower end of the tube of sheet material, depositing a predetermined weight of product in a measuring tube, depositing said product from said measuring tube into said filling tube, if the height of the product in the measuring tube exceeded a predetermined height effecting vibration of the sheet material on the filling tube and the product therein until the product subsides to a level of the product in the filling tube subsides to said level lowering the sheet material from the filling tube so that the tube of sheet material can be sealed to form a bag filled with the predetermined weight of product.

* * * * *